United States Patent [19]

Zakaria

[11] 4,398,919

[45] Aug. 16, 1983

[54] POLYETHOXYLATED COMPOUNDS AS COAL-WATER SLURRY SURFACTANTS

[75] Inventor: Moneeb Zakaria, Western Springs, Ill.

[73] Assignee: Akzona Incorporated, Asheville, N.C.

[21] Appl. No.: 318,283

[22] Filed: Nov. 4, 1981

[51] Int. Cl.[3] ..... C10L 1/32

[52] U.S. Cl. ..... 44/51; 44/70; 44/71

[58] Field of Search ..... 44/51, 70, 71; 252/357; 406/47, 49

[56] References Cited

U.S. PATENT DOCUMENTS 2,128,913 2/1936 Burk ..... 406/47

2,843,464 7/1958 Gaston et al. ..... 44/71

4,297,107 10/1981 Boehmke ..... 44/51

OTHER PUBLICATIONS

McCutcheon, *Detergents & Emulsifiers,* 1973, Allure Publishing Corporation, New Jersey, p. 69.

*Primary Examiner*—Charles F. Warren

*Assistant Examiner*—Margaret B. Medley

*Attorney, Agent, or Firm*—Francis W. Young; Daniel N. Christus

[57] ABSTRACT

The present invention is directed to aqueous-comminuted coal slurries. Specifically, the invention is directed to slurries that include as surfactants about 0.1 to 0.5 weight percent surfactant compounds, as for example polyoxyethylene (2) oleamide, and which typically have a coal solids content of 70%.

10 Claims, No Drawings

POLYETHOXYLATED COMPOUNDS AS COAL-WATER SLURRY SURFACTANTS

BACKGROUND OF THE INVENTION

The present invention is directed to comminuted coal-water slurries as a medium for transporting coal over long distances. Furthermore, the invention is directed to surfactants that maintain coal particles in suspension at a high solids concentration.

In view of the economic dislocations over the past decade due to the sharp increases in the price of imported petroleum, importing countries are seeking ways of exploiting indigenous fuels. For example, the United States can transport coal to diverse parts of the country in an economical way, as by a network of pipelines carrying a coal-water slurry, provided that a sufficient weight percentage of solids is transportable in the slurry. Excessive amounts of water in the slurry result in at least two problems; energy is required to transport the water over the long pipeline distances and to separate the water from the coal in the slurry after the slurry reaches its destination. Surfactant choice is an important factor in a given slurry's pumpability and flowability.

Coal-water slurries of the prior art use a variety of surfactants. For example, in U.S. Pat. No. 4,217,109, entitled "Composition Comprising a Pulverized Purified Substance, Water, and a Dispersing Agent, and a Method for Preparing the Composition", issued to Siwersson et al on Aug. 12, 1980, the surfactants or dispersing agents of the slurry having up to a 60% solids concentration include polyelectrolytes, such as alkali metal or ammonium salts of polycarboxylic acids and polyacrylates. The maximum amount of solids that are pumpable in the ash-water slurry of "Aqueous Slurry of Ash Concentrate and Process for Producing Same", U.S. Pat. No. 4,094,810, issued to Thomas on June 13, 1978, is 60%. Surfactants disclosed in that patent include those consisting of a carboxylic acid salt, a sulfonate salt, a sulfate group, and a phosphate group. U.S. Pat. No. 4,088,453, "Production of Solid Fuel-Water Slurries", issued to Wiese et al on May 9, 1978, and U.S. Pat. No. 3,019,059, "Process for Conveying Carbonaceous Solids Through Conduits", issued to McMurtrie on Jan. 30, 1962, disclose ammonia and coal acids, respectively, as surfactants to improve the pumpability or reduce the viscosity of slurries.

SUMMARY OF THE INVENTION

The present invention is a pumpable coal and water slurry comprising comminuted coal, water, and a surfactant corresponding to the formula:

$$R-\overset{\overset{\displaystyle O}{\|}}{C}-N-[(CH_2CH_2O)_xH][(CH_2CH_2O)_yH],$$

wherein R is an alkyl group having between 8 and 18 carbon atoms, x and y are integers greater than or equal 1, the sum of x and y is between 2 and 15, and wherein the active surfactant content of the slurry is from about 0.1 to 0.5 weight percent.

Even at the high coal solids levels disclosed herein, the slurry is pumpable through conduits. Further, the slurry remains in a substantially uniformly dispersed state because of the surfactants used. The surfactant may have as its R group a straight or branched long chain hydrocarbon group. It may have a degree of ethoxylation in a wide range, between 2 and 15 moles per mole of surfactant.

One of the preferable surfactants, polyoxyethylene (2) oleamide, is sold under the tradename Ethomid ® 0/12 and is available from the Armak Company, 300 South Wacker Drive, Chicago, Ill. 60606. It belongs to a class of N-substituted fatty amides with polyoxyethylene groups as substituents. The Ethomid ® compounds are stable in acid or alkaline solutions, yet can be hydrolyzed with concentrated bases and acids under strenuous conditions. Another of the preferable surfactants is Ethomid ® 0/25, also available from the Armak Company, and known as polyoxyethylene (15) oleyamide.

An object of the invention is a high solids content slurry that is easily pumpable through conduits in that it remains in a liquid-like and pourable form. A further object of the invention is a slurry in which the comminuted coal particles remain in a substantially uniform distribution along a cross-section of the conduit. Further objects of the invention will appear throughout the present specification and claims.

DESCRIPTION OF THE PREFERRED EMBODIMENTS

The present invention contemplates an aqueous slurry of comminuted coal with a surfactant. In accordance with the present invention, a predetermined amount of surfactant is mixed with a predetermined amount of water and then predetermined amounts of comminuted coal are added to the mixture of water and surfactant while mixing to produce the aqueous slurry. The aqueous slurry contemplated by the present invention is a flowable, pumpable mixture which contains up to and in excess of 70% solids. Deionized water was mixed with the coal and surfactant to form the present slurries.

Example 1

An aqueous comminuted coal slurry was produced by adding 46.02 grams of deionized water to 0.5 grams (active=0.250% by weight of total slurry) of 100% active Ethomid ® 0/12 (surfactant) and mixing the resultant mixture by stirring. Relatively small portions of the comminuted coal were added to the mixture of deionized water and surfactant until a total of 153.9 grams of a fine mesh coal of unknown origin and having a moisture content of 9.08% were added. After each portion of the comminuted coal was added to the water and surfactant mixture, the slurry was stirred until the coal had wetted into the slurry. The resulting aqueous slurry of comminuted coal was a 70 percent solids slurry; further, it was pourable and pumpable. There was only slight separation of the water from the coal after five days without agitation.

Example 2

An aqueous comminuted coal slurry was produced by adding 46.02 grams of deionized water to 0.4 grams (active=0.20 percent by weight of total slurry) of 100 percent active Ethomid ® 0/25 (surfactant) and mixing the resultant mixture by stirring. Relatively small portions of the comminuted coal were added to the mixture of deionized water and surfactant until a total of 153.9 grams of a fine mesh coal of unknown origin and having a moisture content of 9.08% were added. After each portion of the comminuted coal was added to the water and surfactant mixture, the slurry was stirred until the coal had wetted into the slurry. The resulting aqueous slurry of comminuted coal was a 70 percent solids slurry; further, it was pourable and pumpable. There was no separation of the water from the coal after five days without agitation.

The present surfactants are thus suitable for maintaining comminuted coal in suspension in a water slurry. They also prevent solidification of slurries having a very high coal content and thereby maintain those slurries in a pourable and pumpable state. By permitting high amounts of coal to be suspended in a pumpable slurry, the invention reduces energy costs of transporting a given amount of coal and reclaiming that coal from the slurry after transport.

What is claimed is:

1. A pumpable coal and water slurry, said slurry comprising comminuted coal, water, and a surfactant corresponding to the formula $$R-\overset{\overset{\displaystyle O}{\|}}{C}-N-[(CH_2CH_2O)_xH][(CH_2CH_2O)_yH]$$

wherein R is an alkyl group having between 8 and 18 carbon atoms, x and y are each integers equal to or greater than 1, the sum of x and y is between 2 and 15, and wherein the active surfactant content of said slurry is from about 0.1 to 0.5 weight percent.

2. The slurry as set forth in claim 1, wherein said slurry has a coal content of at least 70% by weight.

3. The slurry as set forth in claim 1, wherein x and y are each equal to 1.

4. The slurry as set forth in claim 2, wherein x and y are each equal to 1.

5. The slurry as set forth in claim 3, wherein R is $C_{18}H_{35}$-.

6. The slurry as set forth in claim 4, wherein R is $C_{18}H_{35}$-.

7. The slurry as set forth in claim 1, wherein the sum of x and y is equal to 15.

8. The slurry as set forth in claim 2, wherein the sum of x and y is equal to 15.

9. The slurry as set forth in claim 7, wherein R is $C_{18}H_{35}$-.

10. The slurry as set forth in claim 8, wherein R is $C_{18}H_{35}$-.

* * * * *